US007777161B2

(12) United States Patent
Zeyen et al.

(10) Patent No.: US 7,777,161 B2
(45) Date of Patent: Aug. 17, 2010

(54) HEAT-GENERATING ELEMENT OF A HEATING DEVICE

(75) Inventors: Michael Zeyen, Herxheim-Hayna (DE); Kurt Walz, Hagenbach (DE); Michael Niederer, Kapellen-Drusweiler (DE); Franz Bohlender, Kandel (DE)

(73) Assignee: Catem GmbH & Co. KG, Herxheim Bei Landau (DE)

( * ) Notice: Subject to any disclaimer, the term of this patent is extended or adjusted under 35 U.S.C. 154(b) by 296 days.

(21) Appl. No.: 11/534,470

(22) Filed: Sep. 22, 2006

(65) Prior Publication Data

US 2007/0068927 A1 Mar. 29, 2007

(30) Foreign Application Priority Data

Sep. 23, 2005 (EP) ..... 05020752
Sep. 23, 2005 (EP) ..... 05020753
Aug. 16, 2006 (EP) ..... 06017063

(51) Int. Cl.
*H05B 3/06* (2006.01)

(52) U.S. Cl. ..... 219/520; 219/201; 219/208

(58) Field of Classification Search ..... 219/202, 219/505, 536, 504, 520, 537, 540, 541, 544, 219/548, 553; 392/347, 485; 156/291, 292
See application file for complete search history.

(56) References Cited

U.S. PATENT DOCUMENTS 4,327,282 A 4/1982 Nauerth et al.
5,326,418 A * 7/1994 Yeh ..... 156/291
5,471,034 A * 11/1995 Kawate et al. ..... 219/485
5,665,261 A 9/1997 Damsohn et al.
5,756,215 A * 5/1998 Sawamura et al. ..... 428/446
5,995,711 A * 11/1999 Fukuoka et al. ..... 392/347
6,178,292 B1 1/2001 Fukuoka et al.
6,720,536 B2 * 4/2004 Bohlender ..... 219/504
7,012,225 B2 * 3/2006 Bohlender et al. ..... 219/536
2003/0206730 A1 11/2003 Golan
2005/0072774 A1 4/2005 Bohlender

FOREIGN PATENT DOCUMENTS

DE 2845894 A1 4/1980
DE 3022034 A1 12/1981
DE 3208802 A1 9/1983
DE 102 13 923 A1 10/2003
EP 0026457 A 4/1981
EP 1432287 A1 6/2004
EP 1 515 588 A1 3/2005
JP 4-36071 8/1992
JP 6-73654 10/1994

* cited by examiner

*Primary Examiner*—Thor S Campbell
(74) *Attorney, Agent, or Firm*—Boyle Fredrickson, S.C.

(57) ABSTRACT

A heat-generating element of a heating device for heating air including at least one PTC element, electric strip conductors lying on the PTC elements and a longish positioning frame that forms at least one frame opening for holding the minimum of one PTC element. A heat-generating element that is improved with a view to safety from electric flashovers and leakage currents is created with the invention under consideration by providing at least one insulating layer, which covers the strip conductor on its exterior side that is turned away from the positioning frame. The insulating layer in any case is sealed against the long sides of the positioning frame by a compressible sealing bead. A heating device for heating air with multiple heat-generating elements is also disclosed.

12 Claims, 6 Drawing Sheets

HEAT-GENERATING ELEMENT OF A HEATING DEVICE

BACKGROUND OF THE INVENTION

1. Field of the Invention

The invention under consideration relates to a heat-generating element of a heating device for heating air, comprising at least one PTC element and, lying on opposing side surfaces of the PTC element, electric strip conductors. Such a heat-generating element is known, for example, from EP 1 061 776, which is traced back to the current applicant.

In particular, the heat-generating element is deployed in an auxiliary heater for a motor vehicle, and comprises multiple PTC elements, arranged in a row, one behind the other, that are energized via electric strip conductors that extend parallel to one another and that lie flat on opposing sides of the PTC elements. The strip conductors are normally formed by parallel strips of metal. The heat-generating elements formed in this way are deployed in a heating device for heating air in a motor vehicle, where said heating device comprises multiple layers of heat-generating elements having heat-emitting elements that lie on their opposing sides. These heat-emitting elements are positioned so that they lie against the heat-generating elements in a relatively good heat-transferring contact by means of a holding device.

2. Description of the Related Art

In the case of the aforementioned state of the art, a holding device of the heating device is formed by a frame in which multiple layers of heat-generating and heat-emitting elements that run parallel to one another are held by means of a spring bias. In an alternative development, which likewise discloses a generic heat-generating element and a generic heating device and that is described, for example, in EP 1 467 599, the heat-generating element is formed by multiple PTC elements arranged one behind the other, in a row in one level, said PTC elements also being called ceramic elements or positive temperature coefficient thermistors, and being energized on opposing side surfaces by strip conductors that lie on these side surfaces. One of the strip conductors is formed by a circumferentially closed profile, and the other strip conductor by a strip of metal that is supported at the circumferentially closed metal profile with an electrically insulating layer in between. The heat-emitting elements are formed by segments arranged in multiple parallel layers, said segments extending at right-angles to the circumferentially closed metal profile. In the generic heating device known from EP 1 467 599, multiple circumferentially closed metal profiles formed in the manner described in the preceding are provided, said metal profiles being arranged parallel to one another. To some extent, the segments extend between the circumferentially closed profiles and project beyond them to some extent.

In the case of the aforementioned heat-generating elements, there is a requirement that the electric strip conductors must be in good electrical contact with the PTC elements. Otherwise, the problem that arises is an increased transition resistance, which, particularly in the case of the use of heat-generating elements in auxiliary heaters for motor vehicles, can lead to local overheating due to the high currents. As a result of this thermal event, the heat-generating element can be damaged. Furthermore, the PTC elements are self-regulating resistance heaters that emit a lower heat output at an increased temperature, so that local overheating can lead to a disturbance in the self-regulating characteristics of the PTC elements.

In addition, at the high temperatures in the area of an auxiliary heater, vapours or gases can develop that can result in a direct hazard for persons in the passenger compartment.

Correspondingly problematic is also the use of generic heat-generating elements at high operating voltages, such as voltages up to 500 V, for example. For one thing, a problem here is that the air that flows against the heat-emitting elements carries moisture and/or dirt with it, which can penetrate into the heating device and cause an electric flashover, i.e., a short-circuit, here. On the other hand, there is fundamentally the problem of protecting persons working in the area of the heating device from the current-carrying parts of the heating device or of the heat-generating element.

In the case of heat-generating elements of the generic type, the PTC elements are usually arranged in a positioning frame that extends as a flat component essentially in the level of the PTC elements. The positioning frame serves the accurate positioning of the PTC elements during the assembly of the heat-generating element, and optionally also for holding the PTC elements during long-term operation. Because the positioning frame is made of plastic as an injection-moulded part, it consequently has certain insulating characteristics. It has been seen, however, that in generic heat-generating elements when high voltages are used, an electric flashover cannot always be avoided, due to a low resistance to leakage current.

In the state of the art, there has not been a lack of proposals for screening the PTC heating elements against the surroundings. For example, DE 32 08 802 discloses a heat-generating element with a positioning frame and PTC heating elements arranged therein, with said heating elements being sandwiched between opposing strip conductors and this heat-generating element being surrounded by a metallic capsule that is provided with an insulating silicone rubber hose on its interior side, so that the metallic capsule is not in direct electrical contact with the strip conductors. This heat-generating element serves the use in household appliances, press plates and the like, and is incorporated into a press plate for uniform dissipation of the heat generated in the heating element. In the case of this state of the art, the problem that exists is that uniform contacting between the strip conductors and the PTC elements cannot always be guaranteed. In addition, protection of the PTC elements against air and moisture, i.e., the flashover protection, is effected solely by the capsule that completely encloses the PTC elements, which complicates the manufacture of the heat-generating elements and which cannot be used for all conceivable applications of the heat-generating elements, particularly in the case of the use of heat-generating elements in an auxiliary air heater in a motor vehicle.

A heat-generating element is known from U.S. Pat. No. 4,327,282 that is realized without positioning frame and with which the PTC elements, which are arranged behind one another in each case, together with the conducting plates that lie on these elements on both sides and that form the strip conductors and the insulating layers arranged on their exterior sides are held on the long sides. By means of this holding of the layer composition on the long sides, adequate contacting should be effected between the PTC elements and the strip conductors. The mechanism for holding the layer composition on the sides is formed by U-shaped silicone profiles, whose flanges should lie on the insulating layer. It has been seen, however, that in this way, it is not possible to achieve adequate protection of the PTC elements against penetrating moisture and air, particularly when the heat-generating elements are used in an auxiliary air heater in a motor vehicle.

The silicone strips are furthermore relatively soft and can be detached easily, for example, during assembly or repair work on the auxiliary heater.

In an alternative solution proposal, known from EP 0 026 457, the PTC heating element is located within a layer composition, whose outer layers are each formed by an aluminium oxide layer, which outer layers clamping a strip conductor between themselves and the PTC heating element. The aluminium oxide plates are supported along the edges on a rigid plastic frame. The strip conductor is formed by a layer of ductile solder. The application of such a solder layer leads to manufacturing difficulties, however. Furthermore, during operation of the heat-generating element, the problem arises that the solder liquefies in an impermissible manner and produces a short-circuit within the heat-generating element. Due to the rigid support of the aluminium oxide plates on the plastic frame, the known heat-generating element furthermore lacks the ability of resiliently reacting to thermal expansions within certain limits, so that in the case of this state of the art, it is not possible to guarantee secure contacting between the strip conductors and the PTC heating element at all times. The corresponding applies to the heat-generating element known from US 2003/0206730, in which exterior aluminium oxide plates likewise lie on a frame that surrounds the PTC elements.

In the case of the heat-generating element known from U.S. Pat. No. 6,178,192, the PTC element, which is sandwiched between two strip conductors, is completely surrounded by an insulating casing that is formed from an electrically non-conductive plastic, so that, due to the poor thermal conductivity of the plastic material, heat dissipation away from the PTC heating element is hindered. Furthermore, limits are set for the effort to form the casing with a very low wall thickness, because otherwise the problem that occurs is that the casing becomes penetrable, as a result of which the circumferential insulation around the PTC element is destroyed. The moulding of the layer composition of strip conductors and PTC elements also represents a time-consuming manufacturing step, which additionally requires hardening or cooling times, as a result of which the manufacturing is additionally slowed down.

OBJECT OF THE INVENTION

The object of the invention under consideration is to provide a heat-generating element of a heating device for heating air, as well as a corresponding heating device, offering increased safety even in the case of use of high operating voltages. In this process, care should be taken to ensure economical manufacturability of the heat-generating element and therefore the heating device that this constructs. The invention particularly seeks to provide a heat-generating element that provides improved safety against a possible electric flashover.

To solve this problem, the invention under consideration provides a heat-generating element with the features of Claim 1. This differs from the category-defining state of the art in that at least one insulating layer is provided that covers the strip conductor on its exterior side that faces away from the positioning frame, wherein the insulating layers is sealed against at least the long sides of the positioning frame by at least one compressible sealing bead.

Understood as the long side of the positioning frame is particularly the longish edge of the positioning frame as seen in the top view, i.e., that edge strip that surrounds the frame opening or the frame openings on the edge, as a rule in a flat level that forms the upper or lower side of the frame and that surrounds the receptacle opening. A compressible sealing bead is provided on these long sides, with the insulating layer lying tightly against this. The compressibility of the sealing bead is selected in such a way that the strip conductor is pressed against the PTC element(s) by a pushing pressure applied by the insulating layer, namely also at that time when, because of manufacturing tolerances and/or because of differing thermal expansions of the positioning frame on the one hand and the electrically conductive components on the other, the designed dimensioning of the heat-generating element no longer matches the actual dimensioning in this respect. The compressible sealing bead is accordingly suitable for compensating for differing thermal expansions or tolerances between the layer composition comprising the PTC element(s) and the strip conductors and the positioning frame. In the same way, the compressible sealing bead can compensate for any tolerances on the part of the insulating layer, which is preferably formed from a flat ceramic plate. The ceramic plate ideally has roughly the width of the longish positioning frame, but in any case, normally does not project beyond the positioning frame across the width, but is wider than the width of the frame opening. One compressible sealing bead each is preferably provided parallel to the two side edges of the longish positioning frame, between the insulating layer and the positioning frame, preferably essentially across the entire length of the longish insulating layer. On the face sides, the insulating layer can be sealed with respect to the positioning frame in the same way, by means of a compressible sealing bead, so that one or all of the frame openings formed by the positioning frame are arranged within the circumferential sealing formed by the compressible sealing bead, and are consequently hermetically sealed against the exterior. On both sides of the positioning frame, the heat-generating element can have identically provided insulating layers sealed with respect to the positioning frame. Alternatively, the sealing can be provided rigidly on one side of the positioning frame, for example, by means of an insulating layer that surrounds the exterior side of the strip conductor, where said insulating layer is rigidly and tightly connected to the positioning frame, for example, by means of extruding the insulating layer in itself or together with the strip conductor. In this case, a tolerance offset or compensation of differing linear expansions takes place exclusively on the other upper side of the positioning frame. In this case, the sealing bead should be dimensioned thicker there than in the case of sealing beads on opposing sides of the positioning frame.

The heat-generating element according to the invention guarantees close contact between the strip conductor and the PTC element(s) at all times, particularly if the elements of this electrically conductive layer composition of the heat-generating element are laid against one another by means of an external pushing pressure. Contact problems at the transition between the strip conductor and the PTC element are thereby avoided.

The sealing bead can be laid on the positioning frame. With a view to a simpler manufacture of the heat-generating element, it is to be preferred, however, that the sealing bead be glued on to the positioning frame and/or the insulating layer. The sealing bead can also glue the positioning frame to the insulating layer. In such a case, the sealing bead is, for example, formed from a silicone adhesive or the like.

The sealing bead is preferably formed from a highly insulating plastic, i.e., a plastic that shows a high degree of security against electric flashover, even at high operating voltages, for example, one made from a silicone adhesive. Desired is a highly insulating support of the PTC element(s) in the positioning frame, with a CTI value of at least 400, preferably 600, with respect to leakage current. The positioning frame can be formed from a plastic. In this case, the plastic should be temperature-resistant. It is conceivable that, for example, the positioning frame be manufactured of polyamide. With regard to a possible operating voltage of roughly 500 V, the support of the PTC element within the positioning frame should reach a CTI value of at least 600. Materials preferred for use for forming the positioning frame are electrically non-conductive ceramics or an electrically high-grade plastic, such as, for example, polyurethane, silicone or other highly insulating elastomers. The electric dielectric strength of the material that forms the positioning frame should be at least 2 kV/mm, at least for the parts of the positioning frame that are provided directly adjacent to the PTC element(s) and/or that touch this PTC element or these PTC elements.

Alternatively or additionally, the electrically highly effective insulating support of the PTC elements can be accomplished by means of providing an insulating gap between the PTC element and the material of the positioning frame that circumferentially surrounds the frame opening. In the proposed solution according to the invention, the insulating gap prevents the PTC element from coming into direct contact with the opposing inner surfaces of the positioning frame. The insulating gap can be an air gap that is kept free between the PTC element(s) and the material of the frame opening. In the case of this development, it must be ensured that the PTC element is circumferentially kept at a distance from the positioning frame, where the distance is sufficient to prevent an electric flashover to the positioning frame.

This positioning can particularly be accomplished by means of an insulating layer that holds the PTC element(s) in the specified position, for example, by means of connecting, particularly by gluing, the PTC element(s) directly or indirectly to the insulating layer. In addition, the insulating layer is securely held in position with respect to the positioning frame, e.g., by means of gluing with a sealing bead. Even although gluing the aforementioned elements is to be preferred with respect to simpler manufacture and even from the point of view of sealing the current-carrying parts off from the surroundings, where this sealing can be realized by means of an adhesive layer, it is just as possible to space the PTC element(s) by means of positive locking with respect to the positioning frame, while maintaining the insulating gap. The insulating characteristics of this insulating layer are preferably selected in such a way that the insulating layer guarantees a dielectric strength of at least 2,000 V across the width of the layer composition.

Preferably a securing means that encompasses the insulating layer on its exterior side is provided for manufacturing a pre-fabricated structural unit. This securing means preferably encompasses exclusively the insulating layer at its edge, so that the middle section of the insulating layer is free of securing means and, in the case where the securing means is formed by a ceramic track whose exterior side forms a flat bearing surface for a heat-emitting element of a heating device for heating air, the heat-generating element according to the invention can be built into it.

The securing means is formed in such a way that it creates a pressing pre-tensioning force that presses the strip conductor against the assigned PTC element and/or a pretensioning force that holds the insulating layer against the assigned sealing bead in a way that forms a seal. In this way, each heat-generating element of a heating device having multiple layers of heat-generating elements is in itself pretensioned in a way that forms a seal. A spring that holds the layer composition of the heating device under an initial tension can accordingly be used solely to press the heat-emitting elements against the exterior side of the heat-generating elements, which are to be provided as a structural unit, said exterior side preferably being formed by the insulating layer. The spring force is not used for providing an initial tension to the compressible sealing beads, i.e., for sealing the insulating layer against the positioning frame. Such a further development makes possible a more precise design of the heating device. Furthermore, an electric flashover is also prevented with certainty when the spring element that holds the layer composition of the heating device under an initial tension fails or, in any case, effects an inadequate spring force. The heat-generating and heat-emitting elements of the auxiliary heater can also be laid against one another in a manner other than with a spring force, e.g., by means of gluing, without the fear that there could be contact problems between the PTC element and the elements.

The securing means can be formed by means of an molding around that is formed on the positioning frame. The molding around can be formed on after the manufacture of the positioning frame, and in this connection, formed from material either differing from or identical to that of the positioning frame. Alternatively, the securing means is formed by an molding around formed on to the positioning frame in one-piece, said molding around providing the advantage that the securing means and the positioning frame can be constructed in one operational step.

The securing means is preferably formed by a clamp element that encompasses the two exterior sides of the heat-generating element and that preferably lies directly on the exterior side of the insulating layer. The clamp element consequently holds together a prefabricated layer composition as a unit, which consists of the positioning frame, the PTC element(s) incorporated in this frame, the insulating layers lying on the positioning frame in a manner that forms a seal, and the two strip conductors provided between them. In a simple development, the clamp element is formed as a separate component. This further development does not require any complicated technology for manufacturing the heat-generating element. The parts of the layer composition and the clamp elements must be positioned and joined, however.

In an alternative development, the securing means is arranged on the positioning frame as a single piece that can pivot and that is consequently movable with respect to the positioning frame, in order to lay the insulating layer, optionally together with the strip conductor, against the sealing bead when the securing means is pivoted and, as a result of the spring-back securing means, to lay the insulating layer against the sealing bead. In the case of this preferred development, the securing means can, for example, comprise two locking arms that encompass the insulating layers that surround the positioning frame around the outside. These locking arms are preferably connected to the positioning frame in a centred manner, i.e., via a common hinged joint at their connection point. The hinged joint can be formed by a film articulation. Alternatively, the hinged joint can also have a certain stiffness, in order to allow movement of the locking arms for assembly, but, at the same time, to maintain the spring force necessary for providing the initial tension for holding the insulating layer against the compressible sealing bead. This spring force can also be completely or partially generated by the material selection and dimensioning of the locking arms.

With a view to the lowest possible air resistance during the use of the heat-generating element according to the invention in the heating device, it is preferable to provide the locking arms frontally, i.e., on the short ends of the longish positioning frame. The height of the heat-generating element, which usually lies freely in the heating device within a frame, is essentially determined by the height of the side wall of the positioning frame in this development, where this height, in turn, essentially corresponds to the height of the PTC element held therein. The locking arms can project beyond this height, but preferably lie outside of the area that is swept by the air to be heated and within a frame that holds the layer composition of the auxiliary heater or other housing of the heating device.

According to a further preferred development of the invention under consideration, the positioning frame has a frame head that projects beyond the minimum of one insulating layer on the exterior and, in this way, forms a securing means at least for frontal immobilization of the insulating layer relative to the positioning frame. The positioning frame head can be provided in such a way that it is essentially symmetrical with respect to the longitudinal axis of the positioning frame, consequentially forming locking arms that press the insulating layers against the positioning frame on both sides.

The positioning frame head preferably has at least one lead-through opening for a contact tongue that is provided on one of the strips of metal forming the strip conductor. This contact tongue preferably forms the contact plate on one of its face sides in any case. Normally, the contact tongue, which forms a plug connection, is formed or deformed by means of cutting the strip of metal free on a face side of the same, so that the contact tongue extends at a right angle to the plane of the plate. In the case of this development, the contact tongue is formed in one piece on the strip of metal, but with a width that is considerably less than that of the strip of metal that covers the frame opening and that lies on the PTC element. The positioning frame head can furthermore have a positioning opening for a positive-locking fixation of the strip of metal to the other face side.

The contact tongue can also be located in a slot that is made in the positioning frame and that opens outwards to a face side of the positioning frame. By means of this development, there is always an electric plug connection on the face side of the positioning frame, it being possible to slide said plug connection into a holding device of a heating device in order to connect the heat-generating element to the power supply.

For accurate positioning of the electric strip conductor, the positioning frame furthermore has pegs that extend along the height, i.e., at right angles to the supporting plane of the PTC element. Each of the pegs is precisely meshed in a cut that is left in the contact plate. By melting the peg, a thickening is formed above the contact plate, and the contact plate is secured to the positioning frame by means of this thickening. In this development, the contact plate is exactly positioned by the positive locking of the peg and cut. The thickening provides a positive locking of the contact plate to the positioning frame. The insulating layer is preferably glued to the unit formed in this way, whereby the glued connection is preferably located between the positioning frame and the insulating layer.

In this way, a pre-mounted structural unit, comprising the positioning frame, the minimum of one PTC element, the contact plates and the insulating layers, can be formed. When the heat-generating element is later brought together with the heat-emitting element, it is no longer necessary for care to be taken during the later procedural steps to ensure that the individual layers of the heat-generating element are precisely positioned in the frame of the final assembly.

Preferably, there are two slots located on the face side, and the opposing contact plates, with their plug connections formed by means of sheet metal forming, mesh in the slots recessed into the positioning frame.

In an alternative development, the plug connection is formed in any case by sheet metal forming of the contact plate at its face side. The plug connection preferably extends parallel to the remaining contact plate, but, by being bent, it is located in a level that is spaced outwards to the level that holds the contact plate. This preferred development is particularly suited for such arrangements in which the two contact plates on the same face side form electric connection elements that, with a view to the safest possible insulation and the space requirements of plug holders for the connections, should be spaced far apart.

The previously described further developments preferably have separate sealing beads. The sealing bead can be shaped just as well in a single piece with the positioning frame. This realization is particularly necessitated in the case where the positioning frame is formed from an electrically high-grade material. In this case, the insulating layer can, in any case, be connected to the positioning frame on one side by means of molding around. Particularly in this further development, when the insulating layer is extruded to one side of the positioning frame, on the opposite side by means of injection moulding sealing beads can be formed, against which the insulating layer lies on the other side of the positioning frame. Sealing beads can also be formed in a single piece with the positioning frame on opposing sides of the positioning frame by means of injection moulding, and the insulating layers can be placed on these. In such a case, the sealing bead routinely does not develop any adhesion with the positioning frame that is sufficient for the insulating layer. The insulating layer can consequently be laid on to or glued to the sealing beads, or connected to the positioning frame in another manner. Particularly in mind here is clipping an insulating layer on to the positioning frame, either by using clip elements that are arranged on the positioning frame or by using a securing or latching means for the insulating layer, preferably formed on the positioning frame in a single piece and formed so that they are distributed continuously at least on the lengthwise edges of the positioning frame or across the entire length of the positioning frame in discrete sections. Such a latching means can additionally be formed as an attaching and assembly aid on the side for the heat-emitting element that lies on the insulating layer.

The latching means can also be formed as a component that is separate from the positioning frame.

In the case of the invention under consideration, a heating device is furthermore put under protection, said heating device using the heat-generating element according to the invention and accordingly being able to be operated with high voltages. The heating device has multiple heat-emitting elements arranged in parallel layers that lie on opposing sides of a heat-generating element. The heat-generating and heat-emitting elements are held in a housing, for example, a frame, which is essentially flat, with the width of said housing or frame essentially corresponding to the width of the heat-emitting and/or heat-generating elements. Spring tensions can be generated via the frame and/or conducted into the layer composition. To this end, a separate spring element can be integrated in the layer composition or it can be provided in the area of the frame. The spring can be integrated in a frame piece, such as can be derived from EP 0 350 528, for example. Alternatively, the spring bias can also be applied by means of elastic connections of frame pieces that extend at right angles. Preferably, multiple heat-generating elements are provided in the layer composition, with a heat-emitting element on the upper and lower side of each one. The attachment can also be created by means of a glued connection.

The heating device according to the invention is further developed by the further development already discussed in the preceding with reference to the heat-generating element.

Further details and advantages of the invention under consideration result from the following description of embodiments, in conjunction with the drawing. Shown in these Figures are:

DETAILED DESCRIPTION OF THE PREFERRED EMBODIMENT

Figure 1:
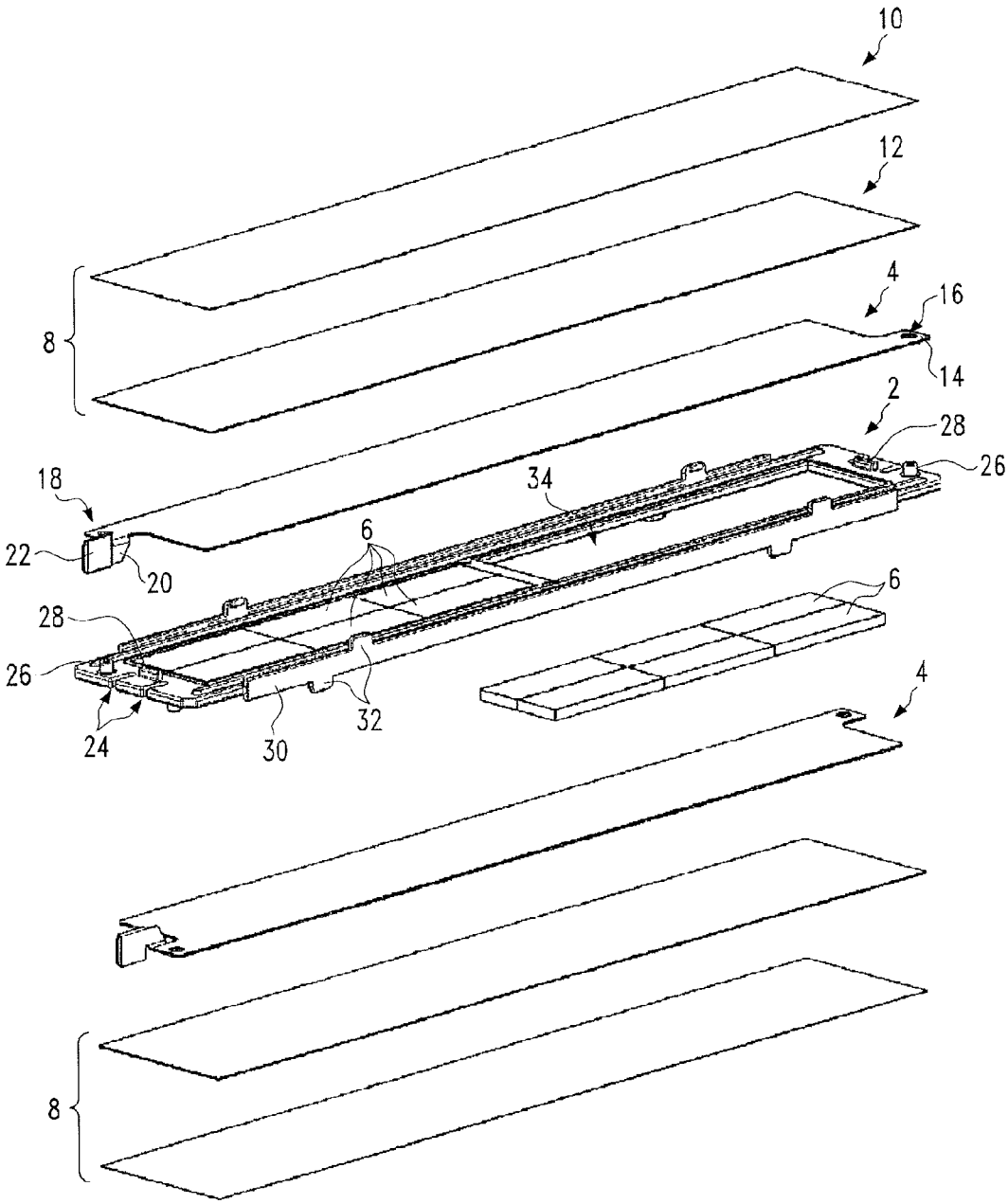
FIG. 1 a perspective side-view onto an embodiment of a heat-generating element in a blown-up representation.
Figure 2:
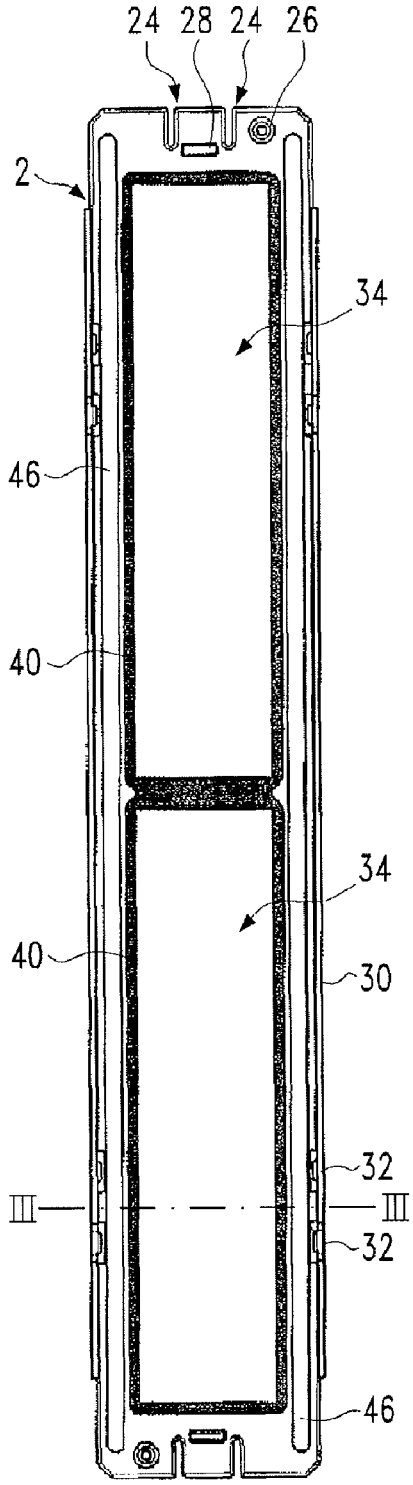
FIG. 2 a top view of the embodiment shown in FIG. 1.

FIG. 1 shows a perspective side-view of the essential parts of an embodiment of a heat-generating element in a blown-up representation. The heat-generating element has a positioning frame 2, made of injection-moulded plastic, whose middle longitudinal axis forms a bisecting plane of the heat-generating element. This element is essentially formed with one side the mirror image of the other, and initially has contact plates 4 provided on each side of the positioning frame 2, said contact plates 4 holding between them the PTC elements 6 held in the positioning frame 2. On the exterior side of the contact plates 4 is located a two-layer insulating layer 8, comprising an exterior insulating foil 10 and an inner ceramic plate 12, that fits directly against the contact plate 4. The ceramic plate 12 is a relatively thin aluminium oxide plate that provides very good electric dielectric strength of roughly 28 kV/mm and good thermal conductivity of more than 24 W/(m K). The plastic foil 10 in this case is formed by a polyamide foil that has good thermal conductivity of roughly 0.45 W/(m K) and dielectric strength of 4 kV/mm. Located between the plastic foil 10 and the ceramic plate 12 is a wax layer, with a thickness of a few μm, whose melting point is coordinated with regard to the operating temperature of the heat-generating element, namely in such a way that the wax melts at the operating temperature and becomes distributed between the plastic foil and the ceramic plate 12, which fit closely together under compressive stress, with the distribution being of such a manner that a levelling film is created that furthers good heat transfer between the two parts 10, 12 of the insulating layer 8. The combination of plastic foil 10 and ceramic plate 12 leads to an insulating part 8 that has good electrical characteristics and thermal conductivity characteristics and, particularly with respect to voltages of up to 2,000 V, that is not subject to flashover, but which simultaneously displays the necessary strength. Any stress peaks that can, in particular, be generated by pressure against the heat-emitting elements that fit against the heat-generating element are relieved and homogenized by the insulating foil positioned around the exterior. The wax that is arranged between the two parts 10, 12 of the insulating layer, as well as, optionally, an adhesive that is also provided there and that connects the two parts 10, 12 to one another, furthers this relief of stress peaks. Accordingly, there is no risk of the relatively brittle ceramic layer breaking, even at higher compressive stresses that hold a layer composition of heat-generating and heat-emitting elements under an initial tension.

The insulating layer 8 is preferably glued to the exterior side of the contact plate 4. This is located roughly centred, below the insulating layer 8, and is formed with a width less than that of the insulating layer 8. The respective contact plate 4 projects beyond the insulating layer 8, however, at the face sides. The width of the contact plate 4 is initially considerably reduced at these ends that project beyond the insulating layer 8. At the right end as seen in FIG. 1, the contact plate 4 has an attachment tab 14, which is narrowed by cutting free some of the width of the contact plate 4 and into which a cut 16 is made. At the opposite end, shown in FIG. 1 at the left, a corresponding narrowed attachment tab 18 with a cut 16 is likewise provided. From the side edge of this attachment tab 18, a tab 20, bent out of the level of the contact plate 4, goes off, forming the basis of a plug connection 22 that projects beyond the positioning frame 2 on the face side.

Figure 4:
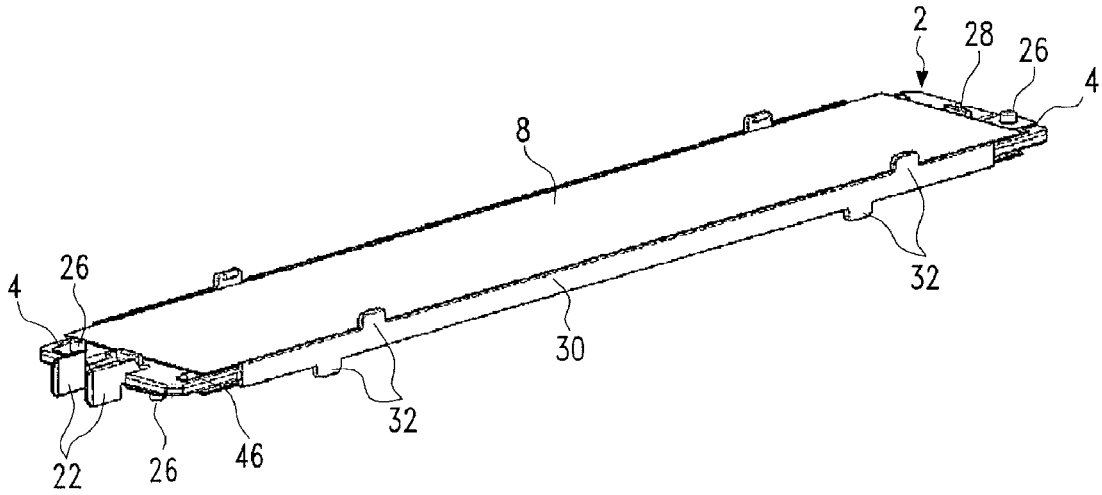
FIG. 4 a perspective side-view of the embodiment shown in FIG. 1 to 3, in the assembled state.

The tab 20 meshes with a slot 24 cut into the positioning frame 2, with said slot 24 opening towards the face side of the positioning frame 2. On its face side end regions, the positioning frame 2 furthermore has pegs 26, that extend along the height of the heat-generating element, i.e., that go off at right angles from the surface of the positioning frame 2. During assembly, these pegs 26 are introduced into the cuts 16. Subsequently, the pegs 26 are melted to form a thickening of melted material and the contact plate 4 is secured to the positioning frame 2 in this manner. As can be derived in particular from FIGS. 1 and 4, the positioning frame 2 has, in addition to the pegs 26, additional positioning aids for precise arrangement of the contact plate 4 on the positioning frame 2. In this way, the positioning frame 2 forms, firstly, face-sided attachment pegs 28 on the face-sided ends of the contact plate 4, said attachment pegs 28 extending slightly beyond the upper side of the contact plate 4 and being spaced at a distance to one another that roughly corresponds to the length of the contact plate 4. In this way, the contact plate 4 is positioned lengthwise. Secondly, across the width, the positioning frame 2 forms bordering edges 30 that extend along almost the entire length of the contact plate 4, said bordering edges 30 likewise extending beyond the upper side of the contact plate 4 and being spaced at a distance to one another that is slightly larger than the width of the contact plate 4. Projecting beyond this bordering edge 30 on both sides are bordering tabs 32 with locking protuberances in the interior, by means of which a heat-emitting element that is arranged on the heat-generating element can be fixed in place for assembly purposes.

Figure 3:
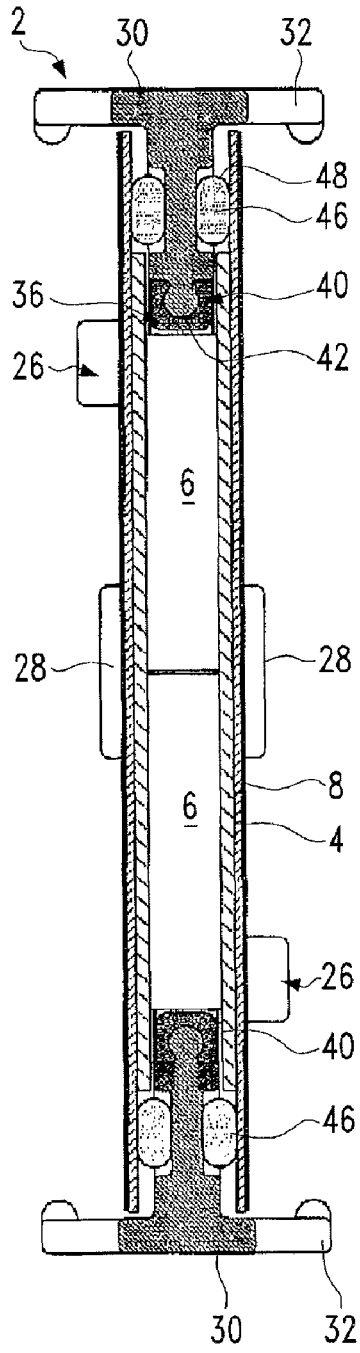
FIG. 3 a cross-sectional view along the line III-III according to the depiction in FIG. 2.

In the heat-generating element, as can be seen in FIG. 3, opposing surfaces of the PTC elements 6 fit against the interior surfaces of the contact plates 4, which are fixed in place in a frame opening 34 of the positioning frame 2. As can be seen in FIG. 1, six PTC elements 6 in each case are located within a frame opening 34. Two equally sized frame openings 34 are provided, arranged one behind the other along the length. The PTC elements are packed at a distance to the material of the positioning frame 2 by means of an insulating gap 36. This insulating gap 36 also extends in a direction parallel to the supporting plane between the interior side of the contact plate 4 and a narrowed interior edge 38 of the positioning frame that surrounds the circumference of the frame opening 34. Accordingly, the current-carrying parts of the heat-generating element, i.e., the two contact plates 4 and the PTC elements 6, are spaced at a distance from the material of the positioning frame 2 by means of the insulating gap 38. In the embodiment shown in FIG. 1 to 4, this distance is ensured by an insulating spacing medium 40, which surrounds the front end of the interior edge 38 around the circumference. In the embodiment shown, the insulating spacing medium 40 is formed by a silicone strip that holds the front area of the interior edge 38 and surrounds it around the circumference.

It is not absolutely required that the current-carrying parts of the heat-generating element fit directly against the insulating spacing medium 40. Rather, the spacing medium is only intended to prevent the current-carrying parts from coming into direct contact with the plastic material of the positioning frame 2. The insulating characteristics of the spacing medium 40 are selected in such a way that in any case, it has a better insulating effect than does the plastic material of the positioning frame 2. The length of the spacing medium 40 across the width is selected in such a way that in any case, it extends to the end of the contact plate 4 corresponding to the width. The spacing medium 40 covers the sides of the interior edge 30 that are open to the top and to the bottom, as well as an edge 42 that is formed by the interior edge 38 and that surrounds the frame opening 34 around the circumference. The spacing medium 40 can accordingly also be understood as the interior insulating jacket coating the edge surrounding the circumference of the frame opening 34, which prevents both direct contact between the PTC element 6 and the thermoplastic material of the positioning frame 2 and direct contact of the contact plates 4 with the positioning frame 2, and ensures a minimum distance between the named parts that is to be maintained for electrical insulation.

In addition to electrical insulation of the current-carrying parts of the heat-generating element, the embodiment shown in FIG. 1 to 4 also offers complete encapsulation of these parts. To this end, the insulating layer has an edge section 44 that extends across (FIG. 3) the contact plate 4 on both sides. Between this edge section 44 and the interior edge 38 of the positioning frame 2 is located a sealing bead 46, which is positioned in such a manner that it lies against and forms a seal with both the positioning frame 2 and the insulating layer 8. In the circumferential direction, i.e., across the width, the encapsulation accordingly has the opposing insulating layers 8 and the arrangement of two sealing elements 46, which extend essentially at right angles, with the material of the positioning frame 2 provided between them. The encapsulation is selected in such a way that no moisture or dirt can penetrate into the current-carrying parts from outside.

The sealing bead 46 is formed by a plastic adhesive that fixes the insulating layer 8 in place with respect to the positioning frame 2, consequently enclosing all parts of the heat-generating element provided within the insulating layers 8. In this development, it is possible to do without fixing the PTC elements 6 in place to the contact plates 4 with respect to the insulating layer 8, as far as positioning during operation of the heat-generating element. Nevertheless, for manufacturing reasons, such an attachment may be expedient.

Elastomers, for example, silicone or polyurethane, have proven suitable for forming the sealing bead 46 in the form of an adhesive. As can particularly be derived from FIG. 2, the sealing bead 46 extends along the length of the positioning frame and is provided between the outer edge of the frame opening 34 and the bordering edge 30. The sealing element fits against the interior edge 38, which has a reduced thickness. On the exterior side, directly adjacent to the sealing element 46, a sealing medium bordering edge 48 is provided that is formed by the positioning frame 2. With a view to the best possible sealing, the sealing bead 46 can fit closely against this edge that extends at right angles to the receptacle level for the PTC elements.

Figure 5:
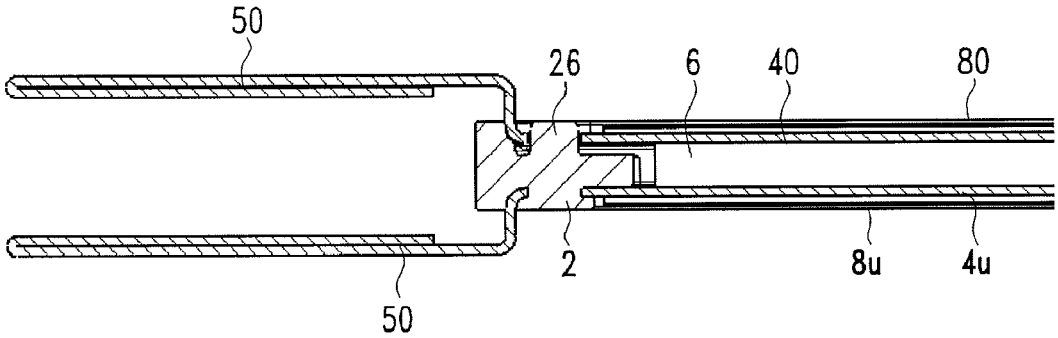
FIG. 5 a longitudinal view of the end piece of an alternative embodiment of a heat-generating element according to the invention.
Figure 6:
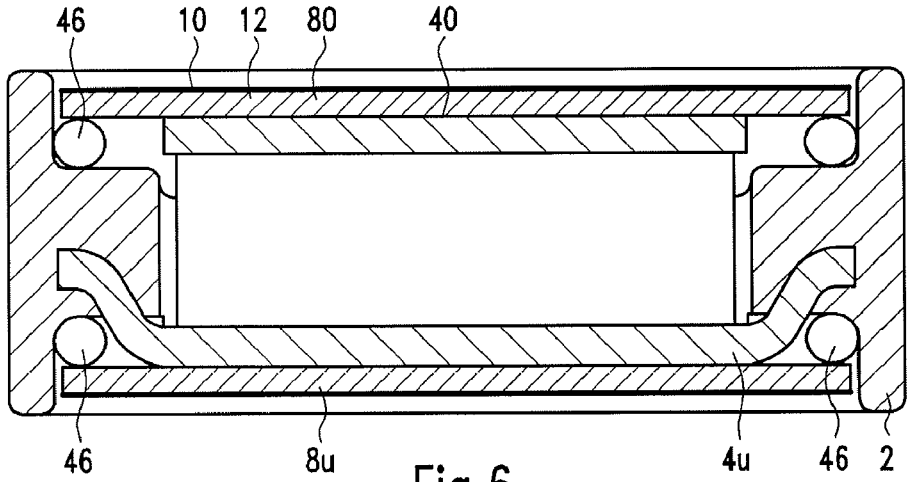
FIG. 6 a cross-sectional view of the embodiment shown in FIG. 6 by means of a third embodiment of a heat-generating element according to the invention.

FIGS. 5 and 6 show an alternative embodiment of a heat-generating element according to the invention, with a positioning frame 2 on which the existing lower contact plate **4*u* is arranged by means of molding around. After the manufacture of the positioning frame 2 by means of injection moulding, this frame forms one unit together with the lower contact plate 4*u*. To this end, the contact plate 4*u* can have cuts or through holes in its edge, through which the highly insulating plastic mass that forms the positioning frame can flow during the injection moulding and can consequently connect the contact plate 4 to the positioning frame. The lower contact plate 4*u* is bent towards the middle of the positioning frame at its ends, so that the contact plate 4*u* is securely surrounded by the material forming the positioning frame 2. In the case of the embodiment shown, the positioning frame 2** is formed from an electrically high-grade, temperature-resistant (200° C.) silicone. The embodiment accordingly has a CTI value that guarantees reliable operation at voltages of roughly 500 V.

In the case of the embodiment shown in FIG. 6, the positioning frame is manufactured while maintaining the fundamental configuration that was already described with reference to the preceding embodiments, in which a sealing adhesive edge 46 is provided between the material of the positioning frame 2 and the insulating layer 8, said adhesive edge 46 being in this case formed from an elastomer adhesive. The two-sided insulating layers 8 lie on the positioning frame 2, with this adhesive strip 46 as an intermediate layer. In this case, the strip 46 fitting against the lower insulating layer **8*u* especially serves the adhesive connection. The sealing characteristics of this strip do not figure in to any great extent. Alternatively or additionally, the insulating layer 8 can also be glued flat to the exterior side of the contact plate 4*u***.

Figure 7:
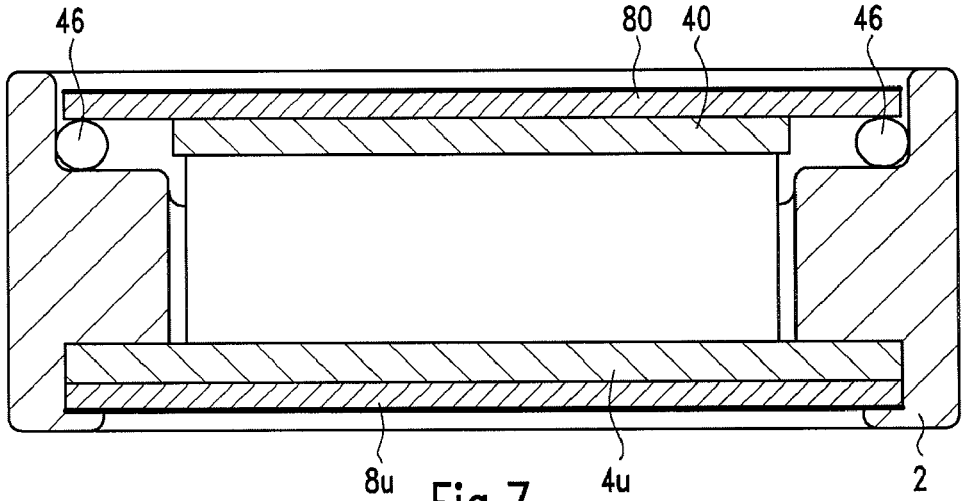
FIG. 7 a cross-sectional view of a third embodiment of the heat-generating element according to the invention.

Alternative developments are also possible, however, in which both the electric strip conductor **4*u* and the insulating layer 8*u* lying on it are inserted into a mould and extruded from the highly insulating plastic mass of the positioning frame 2 (FIG. 7). After the removal of the mould, the PTC elements 6 are inserted into the frame openings 34. On the opposite side, an electric strip conductor 4 is now positioned on the PTC element(s) 6. The insulating layer 8 that is positioned directly on to this electric strip conductor 4 is connected to the positioning frame 2 with an adhesive edge 46 with sealing function. Otherwise, the modification shown in FIG. 7 and described here corresponds to the previously described developments as far as the positioning of the contact plate(s) 4 and the formation of the contact elements at the face-sided end(s) of the positioning frame 2**.

Figure 8:
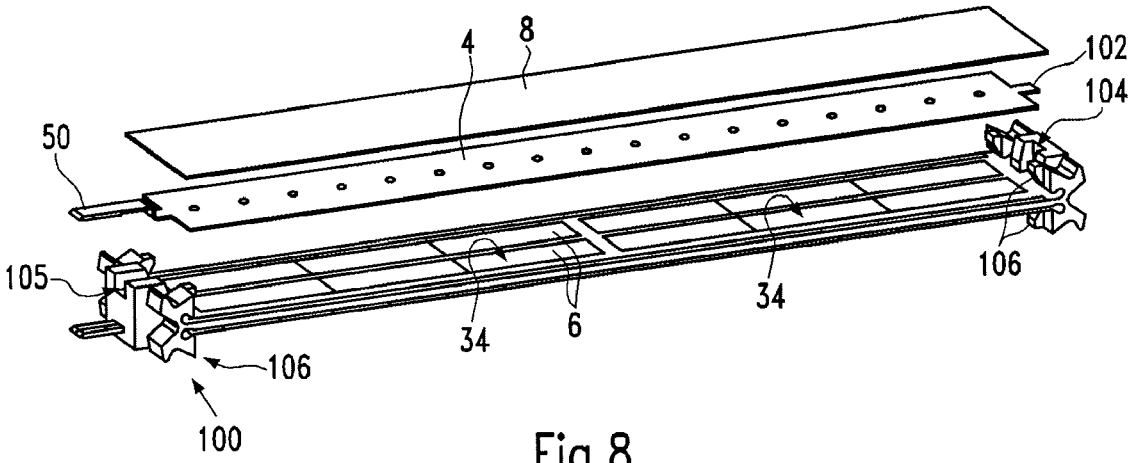
FIG. 8 a side-view in blown-up representation of a fourth embodiment of a heat-generating element according to the invention.
Figure 9:
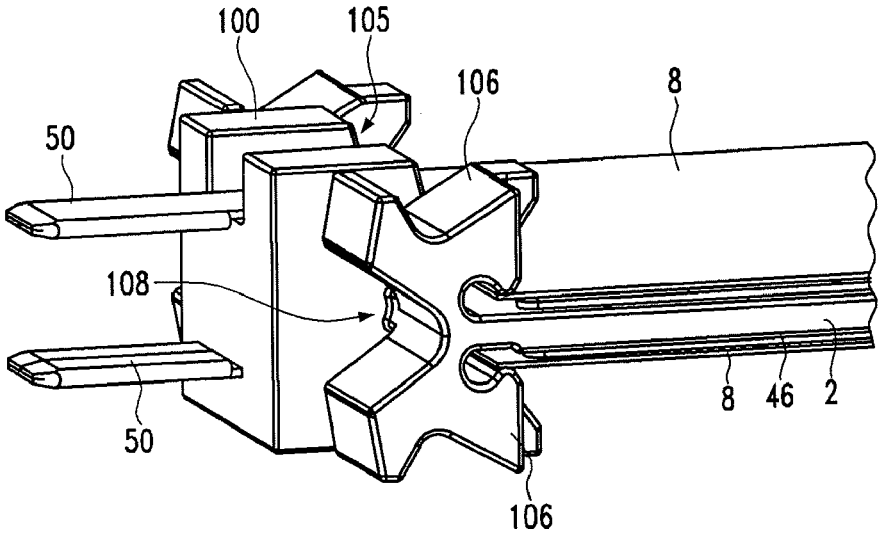
FIG. 9 the left frontal end of the embodiment shown in FIG. 8.

FIGS. 8 and 9 show a fourth embodiment of a heat-generating element according to the invention. Components that are the same as those in the preceding embodiments are identified with the same reference numbers.

In the embodiment shown in FIGS. 8 and 9, the PTC elements 6 are held in two frame openings 34 of a longish positioning frame 2. The PTC elements 6 can lie directly on the edge of the positioning frame 2, said edge surrounding the frame openings 34. Between the frame openings 34 and the longish side edge of the positioning frame 2, two sealing beads 46 are also located, one each on the top and bottom of the positioning frame, where each sealing bead 46 is in the form of a band-shaped, glued-on silicone strip that projects beyond the upper side of the positioning frame. In the case of the embodiment shown, the mutually opposing upper sides of the sealing beads 46 lie roughly at the level of the upper side of the PTC elements. In other words, the two sealing beads 46, together with the thickness of the positioning frame 2 at this side edge have a height that roughly corresponds to the height of the PTC elements.

Positioning frame heads 100, which project beyond the positioning frame 2 on both sides, are provided on both face ends of the positioning frame 2, with said positioning frame heads 100 forming positioning aids for precise arrangement of the contact plates 4. Each of the contact plates 4 has tongues cut out of its face ends, wherein the left tongue forms the plug connection 50 and wherein only a positioning tongue 102 is provided on the right side, said positioning tongue 102 being held in a positioning opening 104 cut into the positioning frame 100 and insulated from it on all sides, so that the contact plate 4 is held securely in the length and width directions relative to the positioning frame 2. The positioning frame head 100 furthermore has a lead-through opening 105 for the plug connection 50.

The positioning frame heads 100 furthermore form a securing structure in the form of locking arms 106 that encompass the insulating layer 8 on the outside, namely, on its face side. The locking arms 106 are linked to the immobile part of the positioning frame head 100 via a shared torsion hinge 108. During the assembly of the embodiment shown in FIGS. 8 and 9, the locking arms 106 can be pivoted around this torsion hinge 108, so that the opposing locking arms 106 open up a free area between them that can just hold the insulating layer 8, formed as a flat ceramic plate. After the release of the torsion hinge 108, the locking arms 106 swing back and span the insulating layer 8. In this connection, the insulating layer 8 is pretensioned in the direction of the positioning frame 2, with a sealing bead 46 being placed in between.

The embodiment shown in FIGS. 8 and 9 can be formed on one side with hinged insulating layers 8 correspondingly locked against the positioning frame 2, whereas on the other side, the insulating layer and/or the contact plate 4 can be secured to the positioning frame 2 in a manner such as that already described in the preceding with reference to FIGS. 6 and 7.

Figure 10:
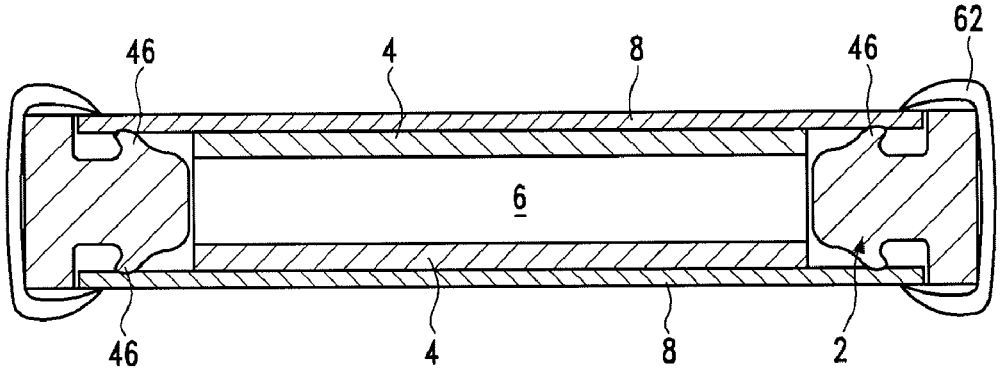
FIG. 10 a cross-sectional view of a fifth embodiment of the heat-generating element according to the invention.

FIG. 10 shows a further modified embodiment. Again, components that are the same in this embodiment as in the previously discussed embodiments are given the same reference numbers.

In the embodiment shown, the sealing beads 46 are formed on opposing side surfaces of the positioning frame 2 as a single piece, on the positioning frame 2 that is formed as an injection moulding component. In the embodiment shown, the positioning frame 2 is injected from silicone. The PTC elements 6 are placed into this frame 2. The insulating layers 8 are positioned on both sides of the sealing bead 46. The components held within the positioning frame 2, the contact plate 4 and PTC elements 6 are clamped between the insulating layers 8. These, in turn, are pretensioned with respect to each other via separate clamp elements 62, which can, for example, be formed by plastic clips formed in a C-shape, that both provide initial tension to the insulating layers 8 with respect to each other, with the positioning frame 2 placed in between, and that also serve the relatively soft and unstable positioning frame 2 as a side border, so that the positioning frame 2 essentially cannot bulge outwards in the supporting plane of the PTC elements 6. Accordingly, the clamp elements 62 are, in any case, arranged so that they are distributed at pre-determined distances along the entire length of the positioning frame 2. The snap-in protuberances of the clamp elements 62 that work with the insulating layer 8 can be assigned snap-in depressions or snap-in protuberances that are mounted on sides of the insulating layer. In addition, the snap-in protuberances can be connected to the insulating layer 8 by means of gluing. Each development that, during the practical use of the heat-generating element, prevents the clamp elements 62 from sliding away from the surface of the insulating layer 8, on the one hand, and that does not hinder the flattest possible positioning of the heat-emitting elements on the exterior side of the insulating layer 8, is conceivable.

Figure 11:
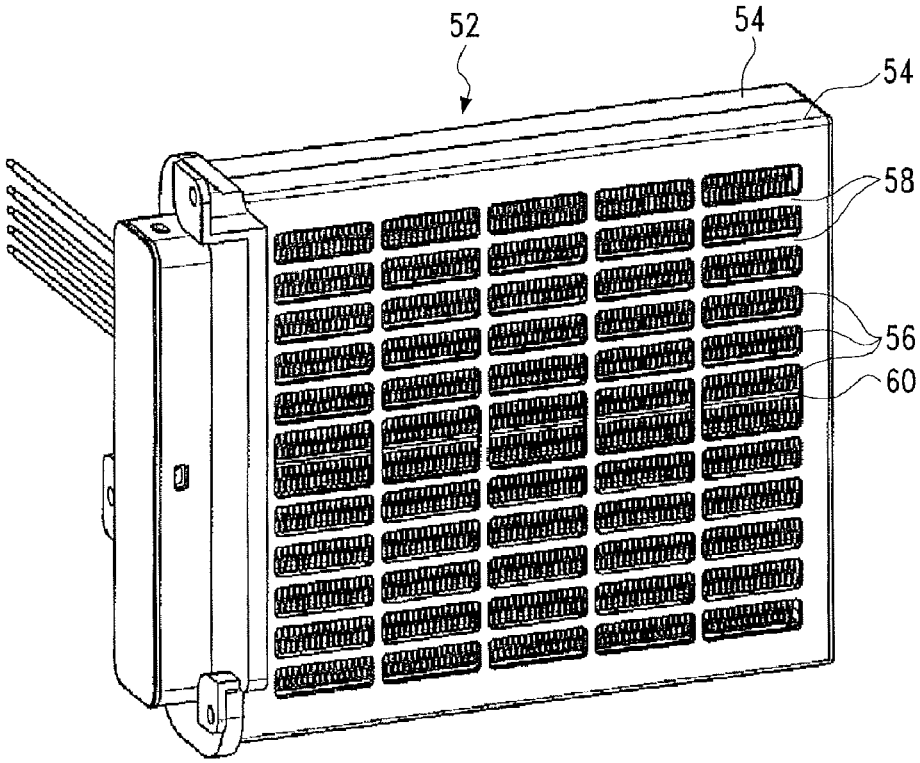
FIG. 11 a perspective side-view of an embodiment of a heating device.

FIG. 11 shows an embodiment of a heating device according to the invention. This comprises a holding device in the form of a frame 52, closed around the circumference, which is formed from two frame hulls 54. Within this frame 52, multiple layers of identically formed heat-generating elements 60 (for example, according to FIG. 1 to 4), running parallel to one another, are held. Furthermore, the frame 52 contains a spring (not shown), by means of which the layer composition is held in the frame 52 at an initial tension. Preferably, all heat-emitting elements 56 are arranged directly adjacent to a heat-generating element 60. The heat-emitting elements 56 shown in FIG. 11 are formed by means of strips of aluminium plating bent in a meandering fashion. The heat-generating elements 60 are located between these individual heat-emitting elements 56 and behind the lengthwise bars 58 of one of the air inlet or outlet openings of the grid that penetrates the frame 52. One of these lengthwise bars 58 is removed from the middle of the frame 52 for the purposes of the depiction, so that a heat-generating element 60 can be seen there.

The force of the spring held in the frame 52 can be dimensioned in such a way that this not only pre-tenses the heat-generating elements 60 and the heat-emitting elements 56 against each other, but additionally so that the corresponding sealing beads 46 are pressed with an initial tension against the insulating layer 8 or the positioning frame 2 in a manner that forms a seal. The sealing effect in this context can be generated solely by the spring force. Additionally, the individual heat-generating elements can be provided with clamp elements or other securing means that provide the initial tension. It is also possible to glue the sealing bead to the insulating layer and/or the positioning frame in a manner that forms a seal. In this case, because of the initial tension of the spring held in the frame, the sealing bead is, in any case, compressed and the contact plate 4 is held flush against the upper side of the PTC element 6, in order to achieve good contacting there. It is self-evident that lead-through or positioning openings 104, 105 cut into the positioning frame are, in this case, dimensioned so that they allow a certain mobility of the contact plate 4 for compressing the sealing bead 46.

In the case of the embodiment shown in FIG. 11, the heat-emitting elements, i.e., the radiator elements, are potential-free, because they lie against the current-carrying parts, with the insulating layer 8 in between. The frame 52 is preferably formed from plastic, as a result of which the electrical insulation can be further improved. Additional protection, particularly against unauthorized contact with the current-carrying parts of the heating device, is additionally provided by the grid, which is likewise formed from plastic and developed as a single piece with the frame hulls 54.

Because the heat-emitting elements 56 fit closely against the current-carrying parts, with an insulating layer 8 placed in between, the heat-emitting elements 56, i.e., the radiator elements, are potential-free. The frame 52 is preferably formed from plastic, as a result of which the electrical insulation can be further improved. Additional protection, particularly against unauthorized contact with the current-carrying parts of the heating device, is additionally provided by the grid, which is likewise formed from plastic and developed as a single piece with the frame hulls 54.

On one face side of the frame 52, a plug connection is located in a manner known per se, with power supply lines and/or control lines going off of it, by means of which the heating device can be connected for control and power supply purposes in a vehicle. On the face side of the frame 52, a housing is indicated which can also have control or regulating elements, in addition to the plug connection.

Even although in the case of the embodiment shown in FIGS. 8 and 9, an attachment edge 30, which projects beyond the sealing edge 46 and which is formed on the positioning frame 2, is missing, the side surface of the heat-generating element, where said side surface can be seen in the side-view, is essentially formed by the side wall of the positioning frame in the case of this embodiment, as well. In the case of the embodiment shown in FIGS. 8 and 9, only the relatively thin sealing bead 46 and the thin ceramic plate 8 project beyond the contact surface for the sealing bead 46 on the sides of the positioning frame 2. It is pointed out that the embodiment shown in FIGS. 8 and 9 has a completely flat surface that extends completely along the width of the heat-generating element. The attachment of the ceramic plate 8 to the positioning frame 2 is accomplished solely by means of the locking arms 106 provided on the face side. If the contact force applied in this way is not sufficient to press the ceramic plate 8 to the sealing bead 46 in the middle area, as well, a corresponding contact force, and therefore shielding of the PTC elements against the air that flows across the heat-generating element, results during the installation of the same into a housing, preferably a frame, due to the spring bias of the layers pressed together in the frame.

We claim:

1. A heating device for heating air, said heating device comprising:

multiple heat-generating elements, each heat generation element comprising at least one PTC element;

electric strip conductors that lie on opposing sides of the PTC element and through which an electric current travels perpendicularly in use;

at least one elongated injection molded plastic positioning frame that forms a frame opening for holding the PTC element and several heat-emitting elements arranged in parallel layers; and at least one ceramic layer that abuts and covers the strip conductors on exterior sides thereof facing away from the positioning frame, thereby electrically isolating the electric strip conductors from the heat emitting elements, wherein said heat-emitting elements are held so that they lie on opposing sides of the PTC element, and wherein the ceramic layer is sealed against at least long sides of the positioning frame by at least one compressible sealing bead, and wherein the at least one ceramic layer provides an abutment face against which the heat-emitting elements abut;

wherein one of the electric strip conductors is secured within the positioning frame by injection molding the positioning frame around the electric strip conductor such that only a lateral portion of the electric strip conductor is surrounded by the injection molded plastic positioning frame.

2. The heating device for heating air according to claim 1, wherein the sealing bead is formed continuously along the length of the positioning frame.

3. The heating device for heating air according to claim 1, wherein the sealing bead is glued onto the positioning frame.

4. The heating device for heating air according to claim 1, further comprising a securing structure that encompasses the ceramic layer along the edge of at least one of the exterior sides of the PTC element.

5. The heating device for heating air according to claim 4, wherein the securing structure creates at least one of a pre-tensioning force that presses the strip conductor against the PTC element and a pre-tensioning force that sealingly holds the insulating layer against the sealing bead.

6. The heating device for heating air according to claim 4, wherein the securing structure is formed by molding around the positioning frame.

7. The heating device for heating air according to claim 4, wherein the securing structure is formed as a single piece on the position frame.

8. The heating device for heating air according to claim 4, wherein the securing structure is formed by a clamp element that encompasses at least the one exterior side of the PTC element.

9. The heating device according to claim 1, wherein the heat-emitting elements are held in a frame with an initial tension so that they lie on the heat-generating elements.

10. The heating device according to claim 1, wherein the ceramic layer of the minimum of one heat-generating element is positioned against the corresponding sealing bead in a manner that forms a seal.

11. The heating device according to claim 1, wherein a heat-emitting element lies directly on an exterior side of the ceramic layer of the corresponding heat-generating element.

12. A heating device for heating air, said heating device comprising:

multiple heat emitting elements;

multiple heat-generating elements, at least some of which are flanked by a pair of heat emitting elements; each heat-generating element including at least one PTC element, first and second electric strip conductors that lie on opposing sides of the PTC element and through which an electric current travels perpendicularly in use, first and second ceramic layers, each of which abuts and covers an associated strip conductor on an exterior side thereof so as to be positioned between the associated strip conductor and an adjacent heat emitting elements, thereby electrically isolating the electric strip conductors from the heat emitting elements, wherein the first and second ceramic layers provide an abutment face against which first and second ones of the pair of heat-emitting elements abut, respectively; and at least one elongated positioning frame that forms a frame opening for holding the PTC element and several heat-emitting elements arranged in parallel layers, wherein said heat-emitting elements are held so that they lie on opposing sides of the PTC element, and wherein said first ceramic layer is sealed against at least long sides of the positioning frame by at least one compressible sealing bead, and wherein one of the electric strip conductors and the second ceramic layer covering said one electric strip conductor are secured within the positioning frame by injecting molding the positioning frame around the electric strip conductor, and wherein only a lateral portion of the electric strip conductor and the second ceramic layer are sealed by injection molding therearound.

* * * * *